United States Patent [19]

Rentmeester et al.

[11] 4,263,338

[45] Apr. 21, 1981

[54] HOT SPRAY

[75] Inventors: Kenneth R. Rentmeester, Barrington; Eugene F. Eike, Crystal Lake; Gerald G. Echternach, Barrington; Leo A. Stukas, Wheaton, all of Ill.

[73] Assignee: American Can Company, Greenwich, Conn.

[21] Appl. No.: 56,701

[22] Filed: Jul. 11, 1979

[51] Int. Cl.[3] ..... B05D 1/02; B05D 3/02; B05D 7/14; B05D 7/22

[52] U.S. Cl. ..... 427/55; 426/398; 427/236; 427/375

[58] Field of Search ..... 427/55, 375, 236, 422; 426/398

[56] References Cited

U.S. PATENT DOCUMENTS

| | | | |
|---|---|---|---|
| 2,085,765 | 7/1937 | Peters | 427/233 |
| 2,735,354 | 2/1956 | Edgar et al. | 426/398 |
| 2,817,600 | 12/1957 | Yahnke | 427/422 X |
| 3,084,051 | 4/1963 | Bromstead et al. | 426/398 X |
| 4,025,664 | 5/1977 | Gerek et al. | 427/233 X |

*Primary Examiner*—James R. Hoffman

*Attorney, Agent, or Firm*—Robert P. Auber; George P. Ziehmer; Stuart S. Bowie

[57] ABSTRACT

A system and method for applying a meat release was to a formed container prior to filling, sealing and processing by application of the wax at elevated temperatures via a hot melt spray and post application of heat to the empty coated container to fuse the hot melt wax into a continuous internal coating to act as a release agent for subsequently added comestibles and the like.

2 Claims, 2 Drawing Figures

HOT SPRAY

BACKGROUND OF THE INVENTION

This invention relates to release agents of the type which are of wax materials, and, more particularly, to a release agent as disclosed in U.S. Pat. No. 2,735,354. More particularly, the use of ethylene bis-stearamide, commonly called Acrawax, as supplied by Glyco Chemicals. While the prior art calls for application of the wax in combination with enamel or lacquer as a dispersion or suspension or by independent swabbing, dipping or fusion coating, those techniques are unsatisfactory and difficult. In particular, the prior art techniques have drawbacks which result in the application of too much Acrawax release agent in a uniform and poorly located coating some of which is inside of the container, on the packed material and on the container tooling.

The combination of the release agent and coating lacquer or enamel has proven to be energy intensive in that the heat required to dry the lacquers and enamels is added to the heat required to fuse the release agent carried in dispersion or suspension. Moreover, the technique of applying the release agent with the lacquer or enamel relies entirely upon the fact that the wax will bloom to the surface during curing. This result is uncertain and as such the coating properties that are particularly desirable for use as a can liner are incompatable in combination with such release agents. For instance, particular coatings that polmerize during curing can be adversely affected such that uniform cross-linking and/or curing does not take place. The result is an uncross-linked oligomer which is not FDA approved and as such is unusable for packing comestibles and the like.

The preparation of containers by coating at high-speed for purposes of providing a low cost package for comestibles and the like requires a uniform, reliable and repeatable processing. It is necessary to be able to apply and cure the coatings in a very brief time span. The addition of the release agent to the coating interfers with the high-speed application and curing of the coating by lengthening the curing times. Consequently, the requisite blooming of the release agent to the surface will not occur. A coating that has Acrawax in it can not be coil coated since such a process does not bring as much to the surface as, for example, sheet baking of coated sheets. Consequently, products that stick like chicken and turkey require additional Acrawax to achieve release.

Thus, it is desired to apply the combination of the coating and the release agent to the sheet stock before forming in order to insure uniform high-speed application, low cost and simplicity of machinery. However, it has been found that the combination once cured tends to interfere with forming tools which are necessary to draw the strip into a container. More particularly, the release agent which tends to be a hard wax material collects on the tooling and because of its consistency and tenacity interfers with the efficient operation of the tooling in that the tools have to be stopped and cleaned in order to maintain their smooth operation and to maintain the dimensional tolerances of the containers. Moreover, the wax buildup tends to attract dirt and particles in the environment which build up in the recesses and crevices of the tooling interferring with the proper forming of the containers and leaving undesirable deposits in the newly formed containers. Wax buildup prevents the tools from attaining their desired stroke resulting in deformed or misformed containers which do not have the designed shape or the desired strength. A package which will not meet its designed properties is unacceptable in connection with the packing of comestibles and the like because any visible exterior failure requires that the packed food be thrown away even though it may be good. The cost of checking outweighs the price of the product and the risk outweighs both.

The materials used for release agents are granular in form and are about the size of finely ground corn meal having the hardness of very hard wax material. As such, it is not easily handled for application of thin coatings as necessary for use as a release agent on the inside of a container. More particularly, it is now shown in the prior art, how a granular material of this type can be applied uniformly to the inside of a formed container at high speeds. For example, such wax has poor solubility in ordinary solvents and even if made soluble, the problem of solvent fumes remains. While the material is also supplied in a micronized powder having a 12 micron powder size, it is more costly to buy the material that way and such material is supplied for the purpose of dispersion or suspension in the enamel or lacquer. Equipment capable of applying such coatings at the speeds and the thicknesses necessary with effective release agent properties is not available for use in connection with either the micronized or the granularized particles.

OBJECTS OF THE INVENTION

It is an object of the present invention to apply a uniform thin coating to the inside of a formed container at high-speed.

It is another object of the present invention to handle granules of release agent and transform them into a hot melt spray for application and subsequent fusion to the inside of a formed container.

It is yet another object of the invention to minimize the release agent buildup on the forming tooling for drawing strip into containers.

It is still a further object of the invention to provide the minimum amount of release agents necessary at the interface between the container inside and the product carried therein.

It is yet another object of the invention to provide a low cost, efficient, economical and reliable method of applying and using release agents in connection with containers for comestibles and the like; which are packed, sealed and processed in the container.

It is still another object to show a method by which release agents can be used with interior base coats which need not be compatible for dispersion in the coating.

In an effort to satisfy the aforesaid and to provide a means by which a prescribed thin coating of release agents can be uniformly applied to the inside of a formed container, an apparatus system and method for handling the granules of release agent and converting them into the desired coating is required.

The prior coating approaches put up to 117 mg of wax on each can. Here release is obtained with only 50 mg per can. The prior art suggests an application of the material by fusing powders dispersed within the can, by applying a solvent carrier or by mixing solvent with the coating, those techniques are wasteful and inefficient in terms of energy usage. The hot spray of the inside of a formed can minimizes the release material added to the finished product thereby not wasting any of the release material and applying a uniform coating of approximately 50 mg±15 mg per can. This is approximately twice what could be applied by mixing with the base coating before coil coating and curing with a short high speed bake. While sheet coating would allow more wax to be put in the coating, the bake time and the energy required would be greater.

The improvement herein is an efficient conservation oriented technique by which the release agent is applied only to the surfaces on which it has to be used and is applied only in the quantity necesssary. More particularly, the heat necessary for applying the release agent is used to liquify the release agent before it is sprayed into the containers. Therefore, energy use is kept to a minimum. Similarly, the amount of material used per container is accurately controlled by a nozzle configuration which evenly disperses the coating about the container inside surfaces.

The granules as received are placed in a kettle and heated above their melting point (approximately 350° F.). The kettle is pressurized above the melt for purposes of conveying the melted wax to a heated atomizing gun. The atomizing gun is of special design in that it must be kept at a high temperature to assure that the melted (liquid) wax does not solidify in the gun or in the nozzles for the gun. More specifically, the wax liquid is conveyed to an interior space adjacent the nozzle aperture by the air applied to the liquid and hot atomizing air drives the wax through the nozzle and disperses it to the container. The combination of the heated gun and the hot air maintains the wax in its liquid state until it has cleared the nozzle aperture and prevents a substantial solidification prior to reaching the container. The surface of the container after the wax has been applied tends to have areas which are coated thinly with the release agent, and so it becomes necessary to heat the container and reflow the deposited wax. The reflow process takes place on a horizontal conveyer under a series of tungsten filament heat lamps which provide adequate infrared energy to sufficiently heat the container and reflow the wax. The heat applied for reflow is controlled by varying the voltage applied to the tungsten filament lamps since too much heat will cause the wax to burn and the base coating to discolor.

The hot spray and reflow technique permits the release agent to be applied to the finished container in a coating of a minimum thickness. This system does not have to rely on the blooming of the wax to the surface because this coating is applied after precoated stock is formed into a container. The problem of wax buildup on the tooling is eliminated. Moreover, any kind of base coating can be used since the wax is not dispersed or suspended with same and thus will not interfere with its curing. By using the aforesaid system and method, three hundred cans per minute can be coated with release agent and fused. Moreover, the base coating can be applied to the sheet before it is formed which permits efficiency in application and minimizes the energy required to cure it. The overall system has been found to be extremely successful in connection with certain meat products such as chicken and turkey and cocktail hot dogs all of which tend to stick to the inside of the container.

DETAILED DESCRIPTION OF THE DRAWINGS

Figure 2:
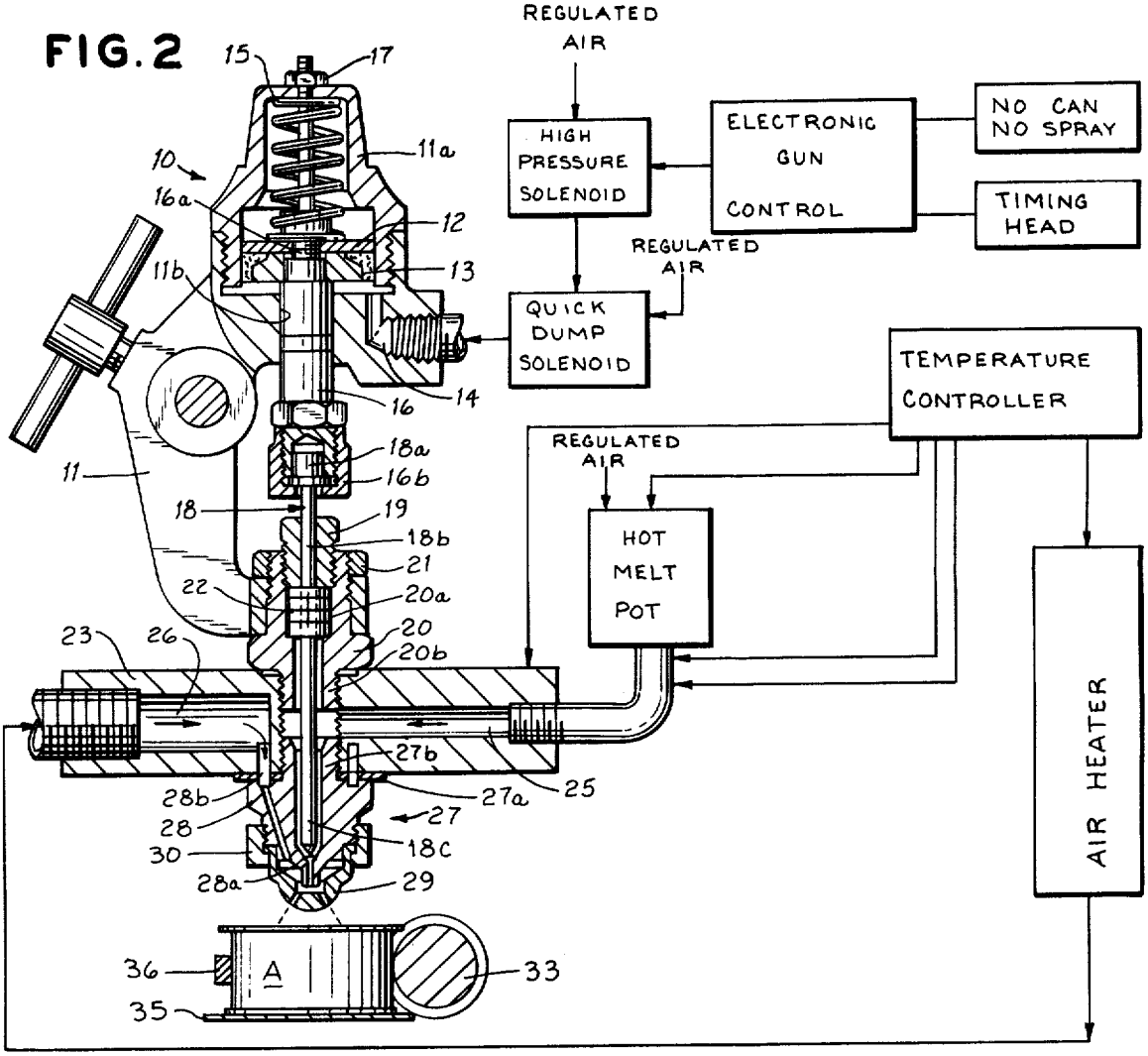
FIG. 2 is a flow diagram in block form showing the control system and inputs to the spray gun shown in enlarged side cross-section.

Turning now to FIG. 2, there is shown a cross-sectional view of the body of a spray gun, manufactured by Spray Systems Company of Wheaton, Ill. The gun is generally labelled 10 and is the type wherein a vertically reciprocal needle valve is air operated to meter pressurized liquid and air through a nozzle. More particularly, there is a spray gun body 11 which supports the overall spray gun and holds the working components thereof in appropriate spaced relation. At the top of the gun there is a piston 12 in the form of a flat washer which rests above a resilient piston seal 13. The piston and seal are connected with an air supply through port 14.

Above the piston 12 is a coil compression spring 15 which bears at its top end inside of a body housing cap 11*a* and at its other end upon the piston 12. The cap 11*a* is threaded for attachment to the body 11. Inside the lower part of cap 11*a* is a bore in which the piston 12 and the seal 13 ride; the bore communicates with port 14. Connected to the piston 12 is an adjustable holding apparatus 16 for carrying the needle valve of the spray gun 10. Apparatus 16 runs through a bore 11*b* in the body 11 and is guided thereby so that apparatus 16 is axially in alignment with the axis of the piston in bore cap 11*a*. More particularly, the overall length of the holding apparatus 16 can be varied such that the relative position of the needle can be set. For this purpose, there is a set of threads 16*a* on apparatus 16 where same is connected to the piston 12. Also in alignment with the axis of the piston 12 and the holding apparatus 16 has an adjustable limit stop 17 which is mounted to the top center portion of cap 11*a*. Limit stop 17 is a threaded rod with a jam nut to set the distance of maximum extension for spring 15.

At the lower end of apparatus 16 there is a mounting for the needle 18. The needle is nail-shaped having a head and shank and a tip each numbered respectively 18*a*, *b* and *c*. The head 18*a* is held to the apparatus 16 by means of an annular internally threaded hollow clamp nut 16*b* which cooperates with the externally threaded lower end of apparatus 16 to capture the head 18*a* of the needle 18 in axial alignment with and normally to the end of holding apparatus 16.

The body 11 at its lower end is arranged to support a needle bushing designed to maintain the shank 18*b* of the needle in axial alignment with the axis of piston 12 and the holding apparatus 16. A needle guide bushing 19 is an externally threaded cylindrically hollow fitting which is received internally in an externally threaded hollow gland nut 20. That is to say that, the external thread of gland nut 20 cooperates with body 11 for mounting thereon and an over nut 21 is provided to clamp and lock gland nut 20 to body 11. Inside the hollow gland nut 20 is a space 20*a* which is cylindrical and axially aligned with the overall axis of the needle 18. In space 20*a* there is provided a tubular packing 22 having an axially aligned opening. Packing 22 is held in place by the needle bushing 19 which is received by internal threads on gland nut 20.

Figure 1:
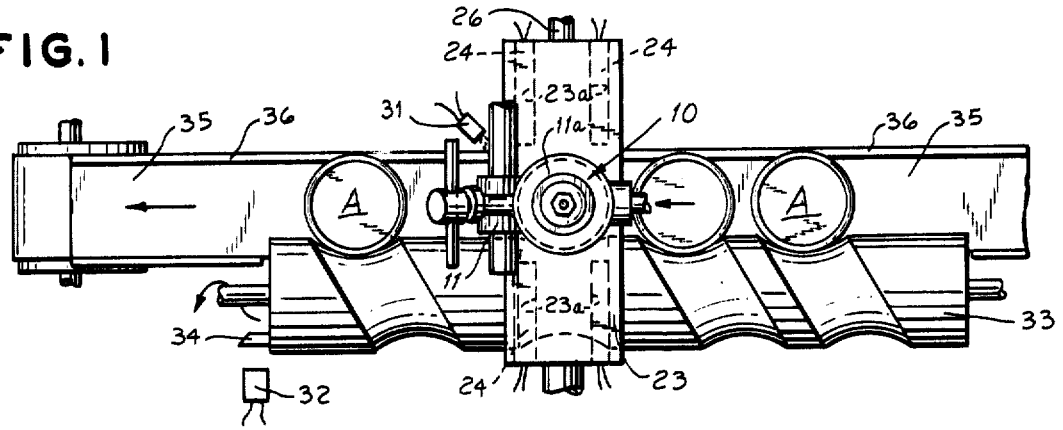
FIG. 1 is a top plan view of the spray gun and a conveyer used in the system and with the method to permit the application of hot melt wax.

Beneath the gland nut 20 is a heater block 23 which includes heating cartridges 24 that are elongated tubular resistance heaters designed to handle 100 watts of power each (FIG. 1). Each heater 24 is retained in a cylindrical bore 23*a* in heater block 23. Bores 23*a* are positioned adjacent to and parallel to inlet ports 25 and 26 which are provided in the heater block 23 to receive hot liquid and hot air respectively. Heater block 23 acts as a heater manifold to supply the materials for spraying under pressure and at a temperature between 300° and 400° F. to a nozzle assembly 27. More particularly, the nozzle assembly 27 includes a gasket 27*a* between heater block 23 and nozzle assembly 27. The heater block 23 is captured between the gland nut 20 and the nozzle assembly 27 by threaded ends 27*b* and 20*b* which extend toward one another into heater block 23 from the gland nut 20 and the nozzle assembly 27 respectively. The nozzle assembly 27 includes a manifolding body 28 which is provided with a hollow axially aligned center bore 28*a* designed to receive the needle tip 18*c*. Also, manifolding body 28 has a channel 28*b* which communicates with hot air inlet 26 whereby air is supplied to the nozzle 27 and, more particularly, through channel 28*b* to the spray nozzle cap 29. Nozzle cap 29 is designed to be held to the manifolding body 28 by a threaded cap nut 30 so that the nozzle cap 29 can be easily changed.

To the right in FIG. 2 is a block diagram to show the inputs for the spray gun 10. At the top is an electronic gun control in the nature of a switch and it receives an "AND" circuit connected to the "no can", "no spray" sensor 31 and from the "timing head" sensor 32. These will be described in connection with FIG. 1 where the "no can", "no spray" sensor 31 is a magnetic proximity switch directed toward the container "A" and located beneath the spray gun 10. The "timing head" proximity sensor 32 is located at the end of conveyor screw 33 and monitors the relative angular position of the screw 33 by means of an element 34 extending from the end of conveyor screw 33 and into path of sensor 32 whereby the relative angular position of the screw 33 can be sensed. When the conveyor screw 33 is in the appropriate position for element 34 to interrupt timing sensor 32 and a container "A" is in the correct position in relation to "no can", "no spray" sensor 31, a spray cycle will be actuated by the electronic gun control "AND" circuit.

When the signals from sensors 31 and 32 are available, the electronic gun control will act to transmit appropriate current to a high pressure solenoid, shown in the block diagram of FIG. 2, whereby the regulated air coming into the high pressure solenoid is connected to a quick dump solenoid in order to open same permitting other regulated air to pass therethrough and into port 14 for purposes of raising piston 12 and thereby opening the needle 18. After the air moves piston 12, the air is also allowed to escape thereby permitting needle 18 to seat as spring 15 returns piston 12 to its rest position for terminating the spraying operation.

Those skilled in the art will appreciate that the conveyer screw 33 can be fabricated with a varying pitch whereby the container A will be brought to a virtual stop beneath the spray gun 10 at the time when the needle 18 has been lifted. An appropriate belt conveyer 35 is below the container A, in order to assure that the container responds to the control of the screw 33 and to support the weight of the container A during its movement underneath the gun 10. There is also a guide rail 36 which is designed to hold the container A against the screw 33 such that the container A is captured for control by the helix thread of the screw 33, see FIGS. 1 and 2.

A hot melt pot is arranged to hold the spray material or release wax at its melting temperature about 350° to 400° F. in order that it will remain a liquid. The hot melt pot is pressurized with regulated air as shown in the block diagram of FIG. 2, whereby a tap at the bottom thereof can continuously supply liquid wax to inlet 25 of the heater block 23. A temperature controller is connected to monitor and regulate the temperature of the heater block 23, the inlet 25 and the tap from the hot melt pot in order to assure that the release wax remains liquid. The temperature controller is also connected to an air heater designed to supply high temperature air to the air inlet port 26 of the heater block 23. The manifolding body 28 of the nozzle assembly 27 acts to join and mix the flow of the heated air and the melted (liquid) wax at a point inside the nozzle cap 29. When the needle 18 is lifted from its seat, liquid wax is allowed to flow and mix with atomizing hot air supplied at 25 pounds per square inch at a rate of 20 SCFM. The nozzle cap 29 has orifices positioned to provide a spray which will cover the inside walls of a cylindrical container with between 10 and 50 mgs per can even though the operation takes place at 300 cans per minute.

Cans leave the spray gun 10 and by conveyer 35 are brought to a reflow oven which is merely a series of radiated heating lamps which raise the temperature or the cans to between 350° and 400° F. depending upon the location on the can where the temperature reading is made. The cans are in the reflow oven approximately 9 seconds and move therethrough at a rate of 98 feet per minute. The radiated energy is supplied by a series of tungsten filament lamps regulated by varying the voltage supplied to each.

While a specific configuration and material have been shown and described, it is felt that the combination of hot spraying and reflowing of generally solid materials should be protected apart from the specified aspects of the preferred embodiment. Those skilled in the art will appreciate and know other arrangements of equipment and controls which will produce like results and, therefore, it is the claims which follow that seek to protect the present invention.

What is claimed is:

1. A method for coating by high pressure spray and melt reflow the inside of a drawn hollow container having a generally cylindrical shape and being opened at one end and closed at the other with a meat release agent in the nature of an ethylene bis-stearamide wax prior to packing the container with meat products and processing same at elevated temperatures and pressures which tend to make the meat adhere to the interior surfaces of the container including the following steps:

(a) melting wax granules in a pressurized kettle at a temperature sufficient to convert the wax into a hot liquid;

(b) transmitting the hot liquid wax to one side of a heater block attached across the supply inlets for a high pressure spray gun for maintaining the wax in a liquid state and distributing the wax to a needle valve in the spray gun;

(c) providing a regulated supply of heated air to the opposite side of the heater block to maintain the temperature of the air and to supply same to the spray gun nozzle for mixing, atomizing and propelling liquid wax through the nozzle orifices toward the interior of the container;

(d) positioning a container fashioned from a heat conductive material which is at a lower temperature than the melting temperature of the wax adjacent the high pressure spray gun nozzle and in axial alignment therewith for receiving the high temperature spray of atomized hot liquid wax at a rate of about 50 mg per container to cause the liquid to immediately solidify and adhere upon reaching the container surface;

(e) controlling an air cylinder connected to open and close the needle valve of the spray gun for selectively permitting the flow of hot liquid wax from the heater block through the needle valve to the nozzle for mixing, atomizing and propelling;

(f) monitoring the position of each container to be sprayed relative to the output of the high pressure spray gun nozzle to assure the operation of the needle valve when an unsprayed container is disposed in alignment with the nozzle, and (g) baking the hot sprayed container in a radiant conveyor oven for about 9 seconds to elevate the container to a temperature of approximately 350°–400° F. to reflow the deposited wax coating forming a substantially uniform and continuous internally waxed surface to inhibit adherence of processed meats.

2. A process for application of meltable solids to a heat conductive surface to be coated with a continuous and uniform layer including the steps of:

(a) melting the solids in a vessel having an inlet and an outlet, (b) applying pressure to said inlet to force the melt through said outlet to a heated block containing a valve means, (c) operating said valve means in accordance with the position of the surface to be coated, (d) mixing hot gas with melt to atomize same, (e) propelling said mixture through orifices to disperse and direct same in a fine spray toward the surface to be coated which is at a temperature below the melting temperature of the solids to quickly solidify and cause adherence of the mixture, and (f) reheating said coated surface to reflow the melt and produce a uniform continuous coating.

* * * * *